US010639776B2

(12) United States Patent
Kamimoto et al.

(10) Patent No.: US 10,639,776 B2
(45) Date of Patent: May 5, 2020

(54) DRIVING TOOL

(71) Applicant: MAKITA CORPORATION, Anjo-shi, Aichi (JP)

(72) Inventors: Junpei Kamimoto, Anjo (JP); Noriyuki Nishido, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 201 days.

(21) Appl. No.: 15/845,253

(22) Filed: Dec. 18, 2017

(65) Prior Publication Data

US 2018/0178362 A1 Jun. 28, 2018

(30) Foreign Application Priority Data

Dec. 22, 2016 (JP) ..... 2016-249514
Dec. 22, 2016 (JP) ..... 2016-249515

(51) Int. Cl.
*B25C 1/04* (2006.01)
*B25C 7/00* (2006.01)

(52) U.S. Cl.
CPC ..... *B25C 1/047* (2013.01); *B25C 7/00* (2013.01)

(58) Field of Classification Search
CPC ..... B25C 1/047; B25C 1/04; B25C 1/041; B25C 7/00
See application file for complete search history.

(56) References Cited

U.S. PATENT DOCUMENTS 4,717,060 A * 1/1988 Cotta ..... B25C 1/08 227/10
5,485,946 A * 1/1996 Jankel ..... B25C 1/042 227/130
5,609,028 A * 3/1997 Kakuda ..... B25C 1/047 60/407
5,878,936 A * 3/1999 Adachi ..... B25C 1/041 227/130
6,041,603 A * 3/2000 Phillips ..... B25C 1/005 227/11
6,045,024 A * 4/2000 Phillips ..... B25C 1/005 227/10
6,260,519 B1 * 7/2001 Phillips ..... B25C 1/005 123/46 R
6,783,050 B2 * 8/2004 Ishizawa ..... B25C 1/047 227/130

(Continued)

FOREIGN PATENT DOCUMENTS

JP 3099285 B2 10/2000
JP 3385875 B2 3/2003

(Continued)

OTHER PUBLICATIONS

Jul. 9, 2019 Office Action issued in Japanese Patent Application No. 2016-249514.

*Primary Examiner* — Andrew M Tecco
(74) *Attorney, Agent, or Firm* — Oliff PLC

(57) ABSTRACT

By utilizing fixing screws serving as an attachment means of a driver guide with respect to a main body housing and fixing screws serving as an attachment means of a top cap with respect to the main body housing, the top and the bottom of the exhaust cover of an exhaust cover in a driving direction may be fixed to the main body housing such that an attachment position of the exhaust cover is maintained in a stabilized manner.

20 Claims, 11 Drawing Sheets

(56) References Cited

U.S. PATENT DOCUMENTS

| | | | | |
|---|---|---|---|---|
| 7,438,207 | B2 * | 10/2008 | Wu | B25C 1/047 227/130 |
| 7,850,055 | B2 * | 12/2010 | Niblett | B25C 1/047 227/130 |
| 7,931,181 | B2 * | 4/2011 | Akiba | B25C 1/08 123/46 SC |
| 8,393,511 | B2 * | 3/2013 | Ogawa | B25C 1/047 227/130 |
| 2008/0105729 | A1 * | 5/2008 | Wu | B25C 1/047 227/130 |
| 2008/0135598 | A1 * | 6/2008 | Burke | B25C 1/047 227/130 |
| 2008/0224421 | A1 * | 9/2008 | Niblett | B25C 1/047 277/638 |
| 2012/0000031 | A1 * | 1/2012 | Liu | B25C 1/08 15/339 |
| 2012/0067935 | A1 * | 3/2012 | Liu | B25C 1/047 227/10 |
| 2013/0319705 | A1 * | 12/2013 | Moore | B25C 1/00 173/20 |

FOREIGN PATENT DOCUMENTS

| | | | |
|---|---|---|---|
| JP | 2008-49440 | A | 3/2008 |
| JP | 2013-126714 | A | 6/2013 |
| JP | 5578251 | B2 | 8/2014 |
| WO | 2008/149903 | A1 | 12/2008 |

* cited by examiner

DRIVING TOOL

CROSS-REFERENCE

This application claims priority to Japanese patent application serial number 2016-249514, filed on Dec. 22, 2016, and to Japanese patent application serial number 2016-249515, filed on Dec. 22, 2016, where the contents of both applications are incorporated herein by reference in their entirety.

TECHNICAL FIELD

The present invention generally relates to a driving tool such as, for example, a nail gun that is driven by compressed air.

BACKGROUND ART

An example of existing prior art is disclosed in Japanese Patent No. 3099285, which shows a nail gun in which high-pressure compressed air is used. In this gun, an exhaust cover is attached to a lateral part of the tool main body in order to reduce an exhaust noise. In Japanese Patent No. 3099285, the exhaust cover is configured to be attached and fixed to a main body by engaging an upper end of the exhaust cover with a lower end edge of a cylinder cap. According to this attachment configuration, the upper end of the exhaust cover is attached to the main body by utilizing the cylinder cap, and thus the attachment configuration of the exhaust cover to the main body can be simplified.

However, regarding a lower end of the exhaust cover, according to the conventional attachment configuration of an exhaust cover, the lower end of the exhaust cover is configured to be engaged with, for example, a rubber layer covering a tool main body for absorbing an impact etc. Because of this unstable configuration, there has been a problem that the exhaust cover is not attached in a stable manner.

Thus, as a result of the mentioned deficiencies in the art, there is a need in the art to attach the exhaust cover in a stable manner and at the same time simplify the attachment configuration.

Furthermore, for example, Japanese Patent No. 3385875 and Japanese Patent No. 5578251 both disclose a driving tool including the added functionality of an air duster blowing away sawdust and/or cutting dust generated around the cutting portion of the tool. The air duster disclosed in Japanese Patent No. 3385875 is configured such that, when a push button disposed on an upper rear face of the tool main body is pressed, compressed air, which is supplied to an accumulator inside a handle, may be blown out from an upper part of the tool main body. In another air duster disclosed in Japanese Patent No. 5578251, a duster valve is arranged at an air hose connection portion (an inlet portion) disposed at a distal end of the handle of the duster, and the flow path of compressed air is divided by said duster valve upstream of the accumulator and the air is blown out from the air injection port of a driver guide through a pipe serving as a dedicated air pipe.

However, the air duster disclosed in Japanese Patent No. 3385875 is configured such that compressed air may be blown out from an upper portion of the tool main body. Because of this configuration, in order to blow out compressed air around a driving (nailing) position, the tool main body may need to be oriented upside down. From this point of view, the usability of the air duster may not be sufficient for the end-use of a user. Furthermore, the air duster disclosed in Japanese Patent No. 5578251 is configured such that the duster valve is arranged around the inlet of the handle and the dedicated air pipe needs to be arranged along a long path from the duster valve to around the injection port. This complicated configuration may cause an increase in cost, and due to the long path of the air pipe, etc. the ease of assembly may be deteriorated, with increased maintenance costs and inconvenience.

Thus, as a result of the mentioned deficiencies in the art, there is also a need in the art to simplify the configuration of the air duster and for improved ease of assembly, efficiency in maintenance, and enhanced usability.

SUMMARY

In one exemplary embodiment of the present disclosure, a driving tool includes a pneumatic piston that moves in a reciprocating manner via compressed air as a driving force, a tool main body that houses the piston, an exhaust cover that is disposed on a lateral side of the tool main body, a driver for driving a driven member, a driver guide that guides the driver, the driver guide being attached to a front of the tool main body in a driving direction, and a top cap that seals an upper piston chamber, the top cap being attached to a rear of the tool main body in the driving direction. Furthermore, the front of the exhaust cover in the driving direction is attached to a main body housing of the tool main body by utilizing an attachment means of the driver guide with respect to the main body housing. Furthermore, the rear of the exhaust cover in the driving direction is attached to the main body housing by utilizing an attachment means of the top cap with respect to the main body housing.

According to the embodiment, the front of the exhaust cover in the driving direction is attached to the main body housing by utilizing the attachment means of the driver guide with respect to the main body housing, and the rear of the exhaust cover in the driving direction is attached to the main body housing by utilizing the attachment means of the top cap with respect to the main body housing. Because of this configuration, the front and the rear of the exhaust cover in the driving direction are configured to be attached to the main body housing at the attachment positions, respectively, in a stable manner. As a result, the attachment position of the exhaust cover with respect to the main body housing can be stabilized.

In another exemplary embodiment of the disclosure, the front and the rear of the exhaust cover in the driving direction are fixed directly to the main body housing at two positions.

According to such an embodiment, the front and the rear of the exhaust cover are fixed to the main body housing at two corresponding front and rear positions of the main body, respectively. As a result, the attachment position of the exhaust cover with respect to the main body housing can be stabilized.

In another exemplary embodiment of the disclosure, a fixing screw is used for the attachment means and an engagement pin is integrally provided with the fixing screw at a tip end thereof. Furthermore, the engagement pin is configured to engage with the exhaust cover such that the exhaust cover can be attached to the main body housing via said fixing screw.

According to such an embodiment, the driver guide and the top cap are screw-fastened to the main body housing by the fastening screws, and the exhaust cover can be fixed to the main body housing by the engagement pins of the fastening screws.

In another exemplary embodiment of the disclosure, the driving tool further includes an air duster device that blows out compressed air from a duster pipe by performing an operation different from an operation for running the tool main body. Furthermore, the duster pipe is configured to be retained by the exhaust cover.

According to such an embodiment, the duster pipe can be retained with respect to the tool main body in a simple manner. As a result, the configuration of the air duster device is simplified, and thus ease of assembly and maintenance of the air duster device can be improved, helping to reduce cost.

In another exemplary embodiment of the disclosure, a display part is provided on the exhaust cover.

According to such an embodiment, the exhaust cover also has the functionality of displaying information. Thus, an area for displaying information can be easily used.

In another exemplary embodiment of the disclosure, a seal member is interposed between the exhaust cover and the main body housing.

According to such an embodiment, air-tightness between the main body housing and the exhaust cover can be improved, in turn improving exhaust efficiency. In this embodiment, the exhaust cover is clamped by a pinched end edge portion of an elastomer rubber layer for absorbing impact that is coated in the main body housing, and the pinched end edge portion serves as the seal member.

In another exemplary embodiment of the disclosure, a driving tool includes a piston that moves in a reciprocating manner via compressed air as a driving force, a tool main body that houses the piston, an exhaust cover that is disposed on a lateral side of the tool main body, a driver for driving a driven member, a driver guide that guides the driver, the driver guide being attached to a front of the tool main body in a driving direction, and a top cap that seals an upper piston chamber, the top cap being attached to a rear of the tool main body in the driving direction. Furthermore, the exhaust cover is fixed to a main body housing of the tool main body by a front and a rear of the exhaust cover in a driving direction both being held by the driver guide.

According to such an embodiment, the exhaust cover is pinched between the front and the rear of the driver guide in the driving direction and fixed to the main body housing. Because of this configuration, the attachment position of the exhaust cover with respect to the main body housing can be stabilized.

In another exemplary embodiment of the disclosure, the driving tool further includes a handle that a user holds, an accumulator that is provided in said handle supplying compressed air to the piston, and an air duster device that blows out compressed air independently from an operation of the tool main body. Furthermore, the air duster device is disposed at a position where a user is able to concomitantly operate the air duster device while holding the handle. Furthermore, the air duster device includes a duster valve by which the accumulator opens and closes and a duster pipe that guides compressed air to a position from which compressed air is blown out. The duster pipe is configured to extend along the tool main body such that compressed air is blown out when the duster valve is opened. Furthermore, a valve stem of the duster valve is configured to move in a width direction of the handle.

According to such an embodiment, the duster valve is disposed to be operated by a user's finger, while the user is holding the handle, in order to blow out compressed air already stored in the accumulator. As a result, the configuration of the tip end of the handle (an inlet portion) can be simplified in comparison with that of prior art. In this respect, ease of assembly and maintenance of the air duster device can be improved, helping to reduce cost.

Furthermore, in said embodiment, the duster valve is disposed at the base portion of the handle, not at the tip end of the handle, such that the user can operate the duster valve while the user is holding the handle. Thus, an arrangement path of the duster pipe can be shortened in comparison with that of the prior art in which the duster pipe must be disposed at the tip end of the handle (inlet portion). In this respect, due to the reduced pipe length and more compact structure, the configuration of the air duster can be simplified, helping to reduce cost.

Furthermore, in said embodiment, the valve stem of the duster valve is configured to be movable in the width direction of the handle and thus the duster valve may be compactly assembled to the handle. Because of this configuration, the configuration of the air duster can be simplified and ease of assembly and maintenance of the air duster device can be improved.

In another exemplary embodiment of the disclosure, the duster valve is disposed between a base portion of the handle and a cylinder that houses the piston.

According to such an embodiment, the duster valve is disposed such that the user can easily operate the duster valve while at the same time holding the handle. Because of this configuration, the configuration of the air duster device can be simplified.

In another exemplary embodiment of the disclosure, the driving tool further includes a switch lever for performing a driving operation of the tool main body. Furthermore, the switch lever is configured to be operated by a fingertip of the user while the handle is being held by the user, where the duster valve is disposed on a rear side with respect to the switch lever in the driving direction.

According to such an embodiment, the user can operate the switch lever with their fingertip while holding the handle, where the duster valve is disposed on the rear side with respect to the switch lever in the driving direction, such that the user can easily operate the duster valve via the switch lever. Because of this configuration, operability of the duster valve can be further improved.

In another exemplary embodiment of the disclosure, an air outlet of the duster valve is disposed in a direction in which the handle extends between the base portion of the handle and the cylinder that houses the piston.

According to such an embodiment, the air outlet port of the duster valve for compressed air is disposed approximately below the trigger in the driving direction such that the air duster device is utilized in the same posture as the posture when the driving operation is performed. In this respect, operability of the air duster device of the driving tool can be improved.

In another exemplary embodiment of the disclosure, the driving tool further includes a contact arm cover that covers a contact arm which helps the user to switch between enabling and disabling a running operation of the tool main body. Furthermore, the duster pipe is retained along the lateral side of the tool main body by the contact arm cover and the exhaust cover.

According to such an embodiment, the configuration of the retaining means of the duster pipe can be simplified. As a result, ease of assembly and maintenance of the air duster device and in turn the driving tool can be improved.

DETAILED DESCRIPTION

Figure 1:
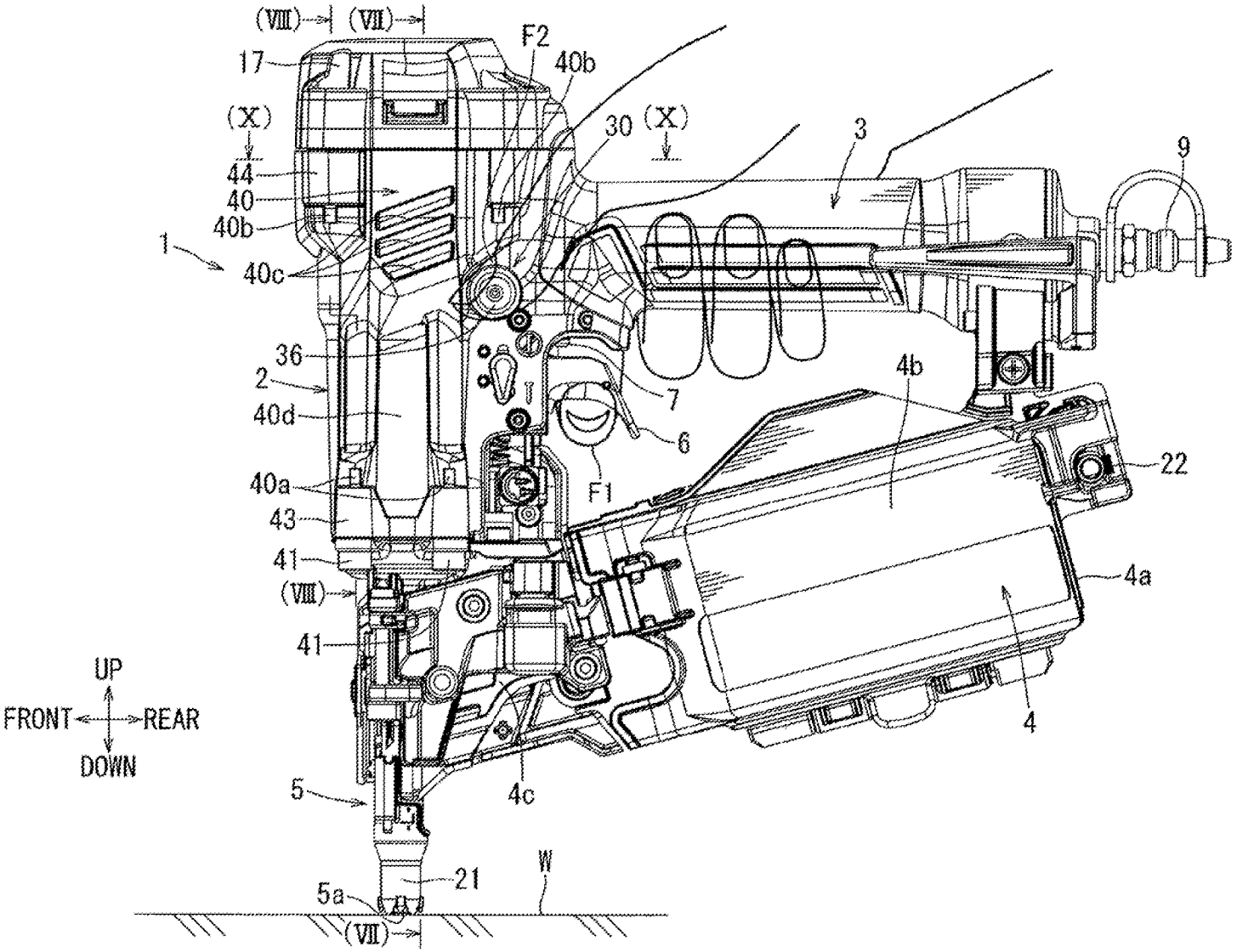
FIG. 1 is an overall side view of a driving tool according to an exemplary embodiment of the present disclosure, showing a left side face thereof viewed from the side of a user.

The detailed description set forth below, when considered with the appended drawings, is intended to be a description of exemplary embodiments of the present invention and is not intended to be restrictive and/or to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, these specific details refer to well-known structures, components and/or devices that are shown in block diagram form in order to avoid obscuring significant aspects of the exemplary embodiments presented herein.

Representative, non-limiting embodiments according to the present disclosure will be described with reference to FIGS. 1 to 12. In the present embodiment, a nail gun driven by compressed air is exemplified as an example of the driving tool 1 as shown in the figures. The driving tool 1 of the present embodiment may be provided with an air duster device 30 through which compressed air is blown out In the present embodiment, the driving tool 1 may have non-conventional features with regard to an attachment configuration of the air duster device 30 and an exhaust cover 40. Fundamental configurations of the cutting tool 1 may not especially need to be modified and thus descriptions thereof may be omitted. In the following embodiment, downward and rearward directions of members and configurations may be based relative to a driving direction of the driven member (nails) and the user's position, respectively, as shown in the figures.

The driving tool 1, which is an air-driven nail gun driven by compressed air as a driving source, may include a tool main body 2, a handle 3 and a magazine 4. A driver guide 5 may be provided at a lower portion of the tool main body 2 so as to protrude in a downward direction. A lower end of the driver guide 5 is an injection port 5*a* from which a driven member (nail) may be driven.

Figure 2:
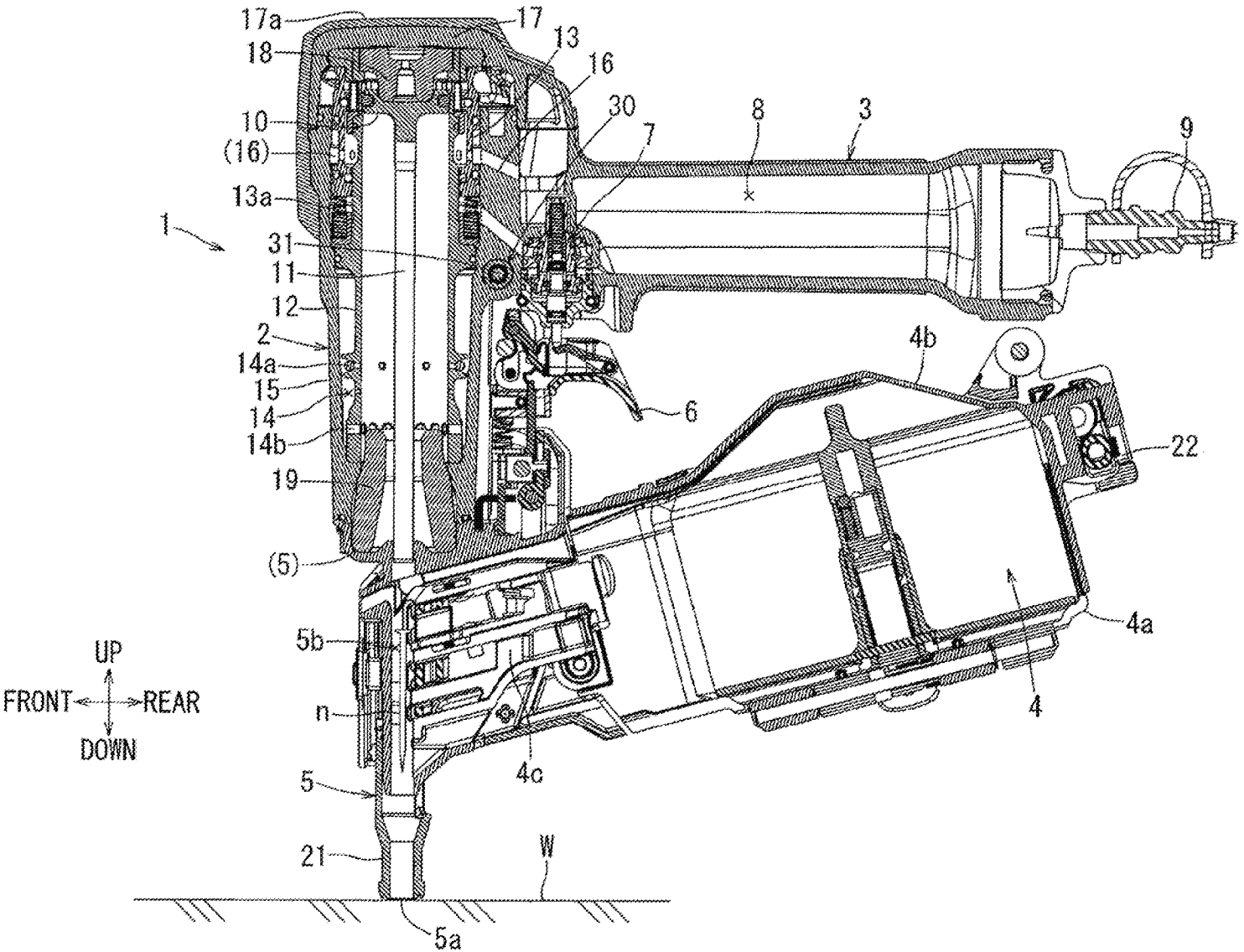
FIG. 2 is a longitudinal sectional view of the driving tool according to the exemplary embodiment.

As shown in FIG. 2, the tool main body 2 may include a tubular main body housing 15 as well as a tubular cylinder 12 concentric with said tubular main body housing 15. A disk-shaped piston 10 may be housed in the cylinder 12 such that the piston 10 can move in a reciprocating manner in the up-to-down direction. A driver 11 for driving (hitting) a nail may be attached to the center of the lower face of the piston 10. The driver 11 may extend in the downward direction and its distal end may reach within a driving passage 5*b* of the driver guide 5. When compressed air is supplied to an upper chamber of the piston 10, the piston 10 may move in the downward direction within the cylinder 12, and the driver 11 for driving (hitting) the nail may consequently move in the downward direction within the driving passage 5*b*. A driven member n (nail) may be supplied in a one-by-one consecutively from the magazine 4 to the driving passage 5*b* corresponding to a driving operation of the tool main body 2. Because of this nail provision configuration, when the driver 11 moves in the downward direction, one driven member n at a time may be driven (hit) by the driver 11 outward from the injection port 5*a* of the driver guide 5*a*. The one driven member driven (hit) by the driver 11 may be driven out from the injection port 5*a* to the (driven) material W.

The handle 3 may be provided so as to protrude in a lateral direction from the lateral portion of the tool main body 2. In the interior of the handle 3, an accumulator 8 for storing compressed air to supply to the tool main body 2 may be provided. A hose connection port 9 for connecting an air hose may be provided at a distal end of the handle 3. Compressed air may be supplied from an air compressor (compressed air source) to the accumulator 8 via the air hose that is connected to the hose connection port 9.

A trigger switch lever 6 and a corresponding trigger valve 7 may be arranged at a base portion of the handle 3. Adjacent to the outer circumference of the upper portion of the cylinder 12, a head valve 13 for opening and closing an upper chamber above the piston 10 with respect to the accumulator 8 may be arranged so as to be movable in the up-to-down direction. The head valve 13 is biased toward an upper closed position by a compression spring 13*a*. FIG. 2 shows a state in which the head valve 13 is positioned in said biased closed position. Compressed air supplied to the accumulator 8 may act on both an upper surface side and a lower surface side of the head valve 13. In an initial state in which compressed air acts on both the upper and lower surfaces, the head valve 13 may be configured to be held to close the upper chamber of the piston 10 owing to the biasing force of the compression spring 13*a* and also a difference in the pressure receiving area between the upper surface side and the lower surface side of the head valve 13. As shown in FIG. 1, the trigger switch lever 6 may be pulled by a user's finger (index finger F1) while the user holds the handle 3. When the switch lever 6 is pulled, the trigger valve 7 may be turned on. When the trigger valve 7 is turned on, the lower surface side of the head valve 13 may be opened to the atmosphere, which causes the head valve 13 to enter a state where the air pressure due to supply of compressed air does not act on the lower surface side of the head valve 13. Because of this state, the head valve 13 may move in the downward direction owing to the air pressure acting on the upper surface side of the head valve 13 and thus the upper chamber above the piston 10 may be open to receive compressed air from the accumulator 8. When the head valve 13 is moved in the downward direction and the upper chamber is open with respect to the accumulator 8, compressed air may be supplied from the accumulator 8 to the upper chamber above the piston 10, which causes the piston 10 to move in the downward direction. The downward movement of the piston 10 may drive one driven member n.

Though not shown in the figures, at a stage when the piston 10 reaches its lowermost end and the driving operation is completed, a part of compressed air flown into the upper chamber above the piston 10 may flow into a return air chamber 14 via a check valve 14*a*, which acts on the lower surface side of the piston 10 and flows compressed air into this region via vent hole 14*b*. Furthermore, when the pulling operation of the switch lever 6 is released after the driving operation is completed, the trigger valve 7 is returned to an off position. When the trigger valve 7 is in said turned off position, the state of the head valve 13 may change such that compressed air from the accumulator 8 acts on the lower surface side of the head valve 13 again as it did before the trigger pulling operation occurred, and thus the head valve 13 may be moved in the upward direction owing to the biasing force of the compression spring 13*a* in tandem with the air pressure due to the supply of compressed air. As shown in FIG. 2, when the head valve 13 is moved in the upward direction, the upper chamber above the piston 10 may be closed with respect to accumulator 8 and opened to the atmosphere. Compressed air already in the upper chamber of the piston 10 may be exhausted to the outside via an exhaust hole 16 provided in the main body housing 15. An exhaust cover 40 may be attached to the lateral outer peripheral portion of the main body housing 15 in a manner so as to cover the exhaust hole 16. In the present embodiment, the driving tool 1 may have non-conventional features with respect to an attachment configuration of the exhaust cover 40, which will be discussed in detail infra.

The magazine 4 may load a plurality of driven members (nails) that are combined in parallel at a predetermined interval. The magazine 4 may include a tubular-box-shaped holder 4*a* that houses the combined driven members in a spiral manner. The magazine 4 may also include a cover 4*b* that covers the holder 4*a*. A feeding mechanism 4*c* for pitch-feeding the combined driven members one-by-one into the driving passage of the driver guide 5, such that the member may be driven by the driving operation of the tool main body 2, may be provided between the magazine 4 and the driver guide 5. The combined driven members that are loaded in the magazine 4 may be pitch-fed by the operation of the feeding mechanism 4*c* in tandem with the driving operation of the tool main body 2, where the driven member n may be supplied consecutively one-by-one into the driving passage 5*b* of the driver guide 5.

Figure 3:
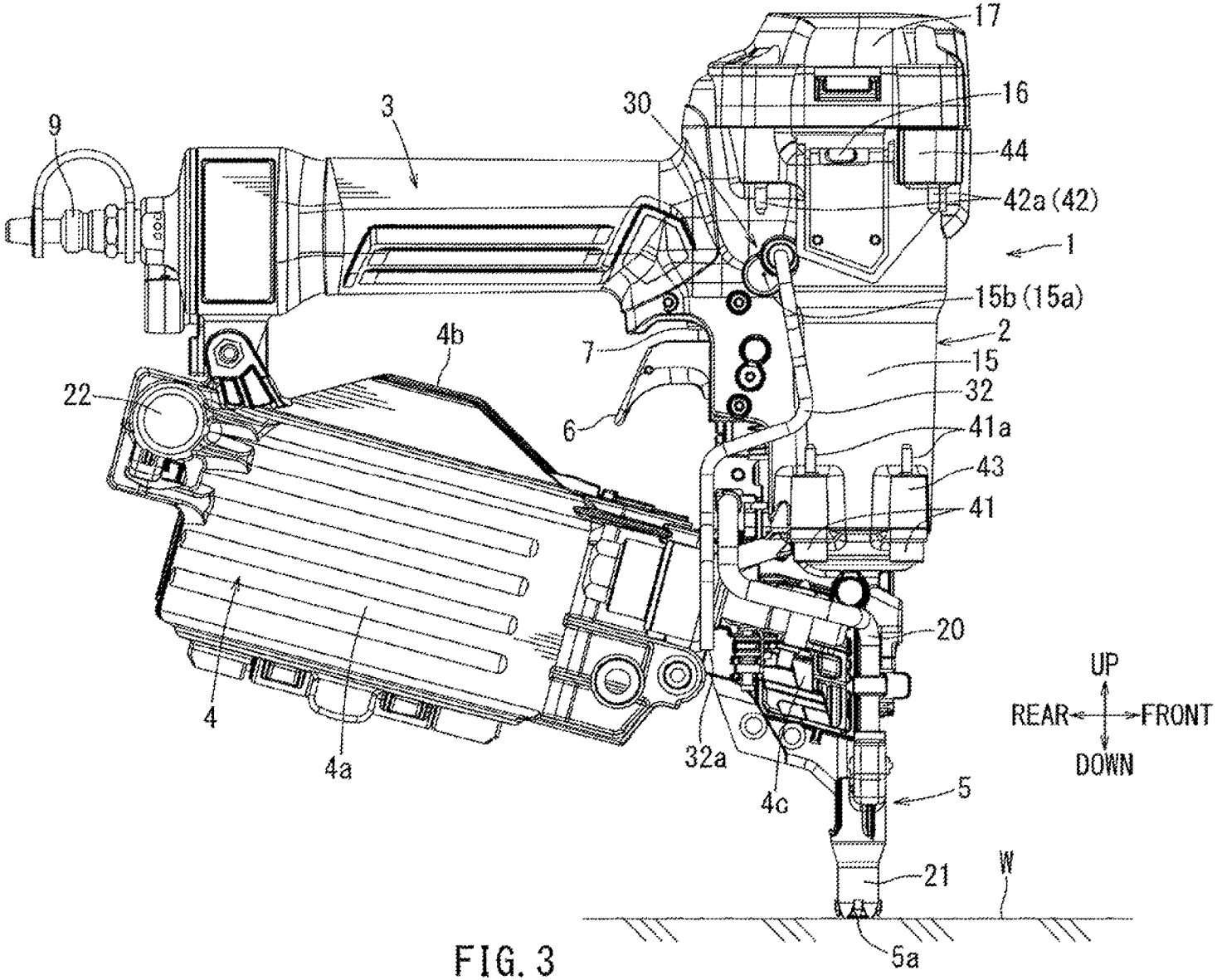
FIG. 3 is an overall side view of the driving tool according to the exemplary embodiment, showing a right side face thereof viewed from the side of the user. This figure shows a state in which a contact arm cover and an exhaust cover are removed therefrom and a duster pipe is exposed to outside.

A contact arm 20 for switching between enabling and disabling of the pulling operation of the switch lever 6 may be provided in the driver guide 5. As shown in FIG. 3, the contact arm 20, which is formed by bending a thin bar material, may be supported so as to displaceable in the up-to-down direction along mainly the right side of the driver guide 5. A contact top 21 may be attached to the lower portion of the contact arm 20. The contact top 21 may be made from metal formed in approximately a tubular shape, and may be coaxial with and positioned below the driver guide 5. A distal end opening of the contact top 21 may be the injection port 5*a*.

As shown in the figures, the contact top 21 may be relatively movable with regard to the driver guide 5 by pushing the driving tool 1 in the driving direction while the contact top 21 is brought into contact with the (driven) material W. A pulling operation of the switch lever 6 may be effective when the contact arm 20 is moved relative to the driver guide 5 by the pushing operation of the contact top 21. Because of this configuration, only when the driving tool 1 is pushed in the downward direction while the contact top 21 is being brought into contact with the (driven) material W and pushed upwards to in turn relatively move the contact arm 20 in the upward direction, the pulling operation of the switch lever 6 can be effective and the driving operation can be performed. In contrast, in the case where the contact arm 20 is not moved upward with respect to the driver guide 5, even if the switch lever 6 is pulled upward to place the trigger valve 7 in an activated position, the trigger valve 7 is not placed in an activated position and the driving operation may not be performed.

The contact top 21 can be exchanged for another contact top depending on the corresponding length of the driven member. In addition, an auxiliary contact top not in use may be housed in a contact top storage part 22 that is provided in the rear of the magazine 4.

The driving tool 1 of the present embodiment may be provided with the air duster device 30 by which compressed air can be blown out by user operation in addition to a series of driving operations of the tool main body 2. Sawdust and/or cutting dust generated around the (driven) material W may also be blown away by compressed air that is blown out from the duster device 30, which can improve visibility around the (driven) material W and rapidly perform a precise driving operation. Different from conventional prior arts, the air duster 30 of the present embodiment may not be positioned on the tip end of the handle 3, but rather may be provided on the lateral portion of the tool main body 2. In particular, the air duster 30 may be provided between the base portion of the handle 3 and the cylinder 12 with respect to the front-to-rear direction in which the handle 3 extends. Because of this configuration, as shown in FIG. 3, the air duster device 30 of the present embodiment can be utilized by pushing a duster button 36 with, for example, a user's thumb F2, without re-gripping the handle 3.

Figure 5:
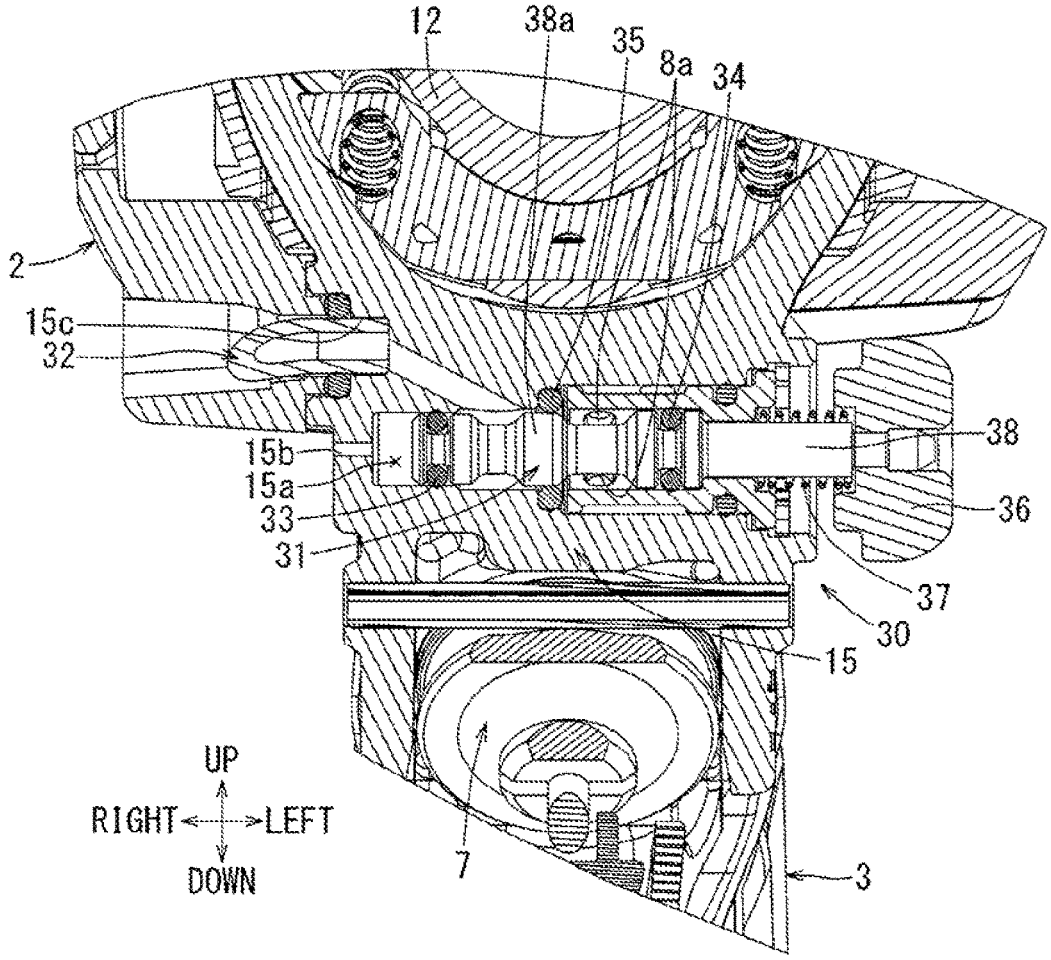
FIG. 5 is a cross-sectional view taken along line (V)-(V) of FIG. 4, showing a longitudinal sectional view of a duster valve and its surroundings. This figure shows an off-state of the duster valve.
Figure 6:
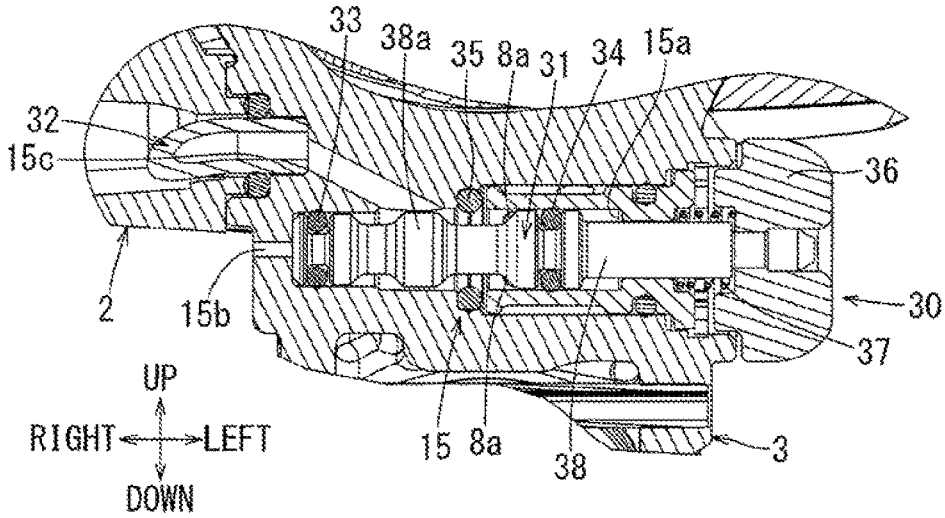
FIG. 6 is a cross-sectional view taken along line (VI)-(VI) of FIG. 4, showing a longitudinal sectional view of the duster valve. This figure shows an on-state of the duster valve.

FIGS. 5 and 6 show the air duster device 30 in detail. The air duster device 30 may include a duster valve 31 and a duster pipe 32. The duster valve 31 may be arranged to the rear of the main body housing 15. In particular, it may be located between the cylinder 12 and the trigger valve 7. The duster valve 31 may be configured such that a valve stem 38 is housed within a valve recess 15*a* provided in the main body housing 15 in a sealed manner. A right end portion of the valve recess 15*a* may communicate with the atmosphere via an air vent 15*b*. By being exposed to the atmosphere, the air vent 15*b* may prevent generation of a negative pressure in the valve recess 15*a* to thus obtain and/or ensure a smooth movement of the valve stem 38. A first seal ring 33 and a second seal ring 34 may be attached to the valve stem 38. The first seal ring 33 and the second seal ring 34 may be brought into slide contact with the inner wall surface of the valve recess 15*a* in a sealed manner. Furthermore, a third seal ring 35 may be attached to the inner wall surface of the valve recess 15*a*. Between the first seal ring 33 and the second seal ring 34, the third seal ring 35 may be brought into slide contact with the outer circumferential surface of a switching portion 38*a* having the largest width of the valve stem 38.

A left end portion of the valve stem 38 may protrude outward from within the valve recess 15*a* in the leftward direction. A disc-shaped duster button 36 which the user may operate via their fingertip may be attached to the left end portion of the valve stem 38. A compression spring 37 may be interposed between the duster button 36 and one side of the valve recess 15*a*. In FIGS. 5 and 6, the valve stem 38 may be biased in the leftward direction (toward an off-side) by the compression spring 37. FIG. 5 shows an off-state of the duster valve 31 and FIG. 6 shows an on-state of the duster valve 31.

In the off-state shown in FIG. 5, the third seal ring 35 may be brought into slide contact with the switching portion 38*a* of the valve stem 38. Because of this sealing configuration, in the off-state of the duster valve 31, the valve recess 15*a* may be partitioned in a sealed manner into two compartments, i.e., a right compartment between the first seal ring 33 and the third seal ring 35 and a left compartment between the third seal ring 35 and the second seal ring 34, as shown in FIG. 5. The duster pipe 32 may be connected to the right compartment between the first seal ring 33 and the third seal ring 35. Furthermore, a vent hole 8*a* from the accumulator 8 may be opened in the left compartment between the third seal ring 34 and the second seal ring 35. In the off-state shown in FIG. 5, a seal can be made between the duster pipe 32 and the vent hole 8*a* by the third seal ring 35 and thus compressed air may not be supplied to the duster pipe 32.

In contrast, as shown in FIG. 6, when the duster button 36 is pushed on the right side (on side) against the biasing force of compression spring 37, the switching portion 38*a* of the valve stem 38 may be consequently pushed to the right of the third seal ring 35, breaking the previous seal. In the on-state shown in FIG. 6, the right compartment between the first seal ring 33 and the third seal ring 35 may communicate with the left compartment between the third seal ring 35 and the second seal ring 34 through interior region of 15*a* adjacent to the inner peripheral side of the third seal ring 35. Because of this configuration, compressed air can be supplied to the duster pipe 32 from the accumulator 8 via the vent hole 8*a*.

As shown in FIG. 3, an arrangement path of the duster pipe 32 may be configured to extend from around the base portion of the handle 3 to the driver guide 5 along the right side of the tool main body 2. As shown in FIGS. 5 and 6, the upstream end portion of the duster pipe 32 may be inserted and tightly connected to a connection hole 15*c* provided in the main body housing 15 in a sealed manner. A lower end portion (blowing-out port 32*a*) of the duster pipe 32 may be positioned to the rear of the driver guide 5 and to the right of the feeding mechanism 4*c* for feeding the driven members. As shown in FIG. 6, when the duster valve 31 is turned on, compressed air may be blown through the duster pipe 32, out from the blowing-out port 32*a* of FIG. 3, in the same direction as in the driving direction of the driven member n (in the downward direction). Compressed air that is blown out from the blowing-out port 32*a* can blow away sawdust and/or cutting dust generated on the (driven) material W, which can improve visibility around the (driven) material W.

When the user releases the pushing operation of the duster button 36 by releasing their fingertip, the valve stem 38 may be returned to an off position shown in FIG. 5 due to the biasing force of the compression spring 37. When the valve stem 38 is returned to the off-position, the switching portion 38*a* of valve stem 38 may be returned to engage in a seal-fit with the inner peripheral side of the third seal ring 35 and the duster pipe 32 may consequently be shut off from the accumulator 8 in a sealed manner. As a result, compressed air may be stopped from being blown out from the blowing-out port 32*a*.

Figure 4:
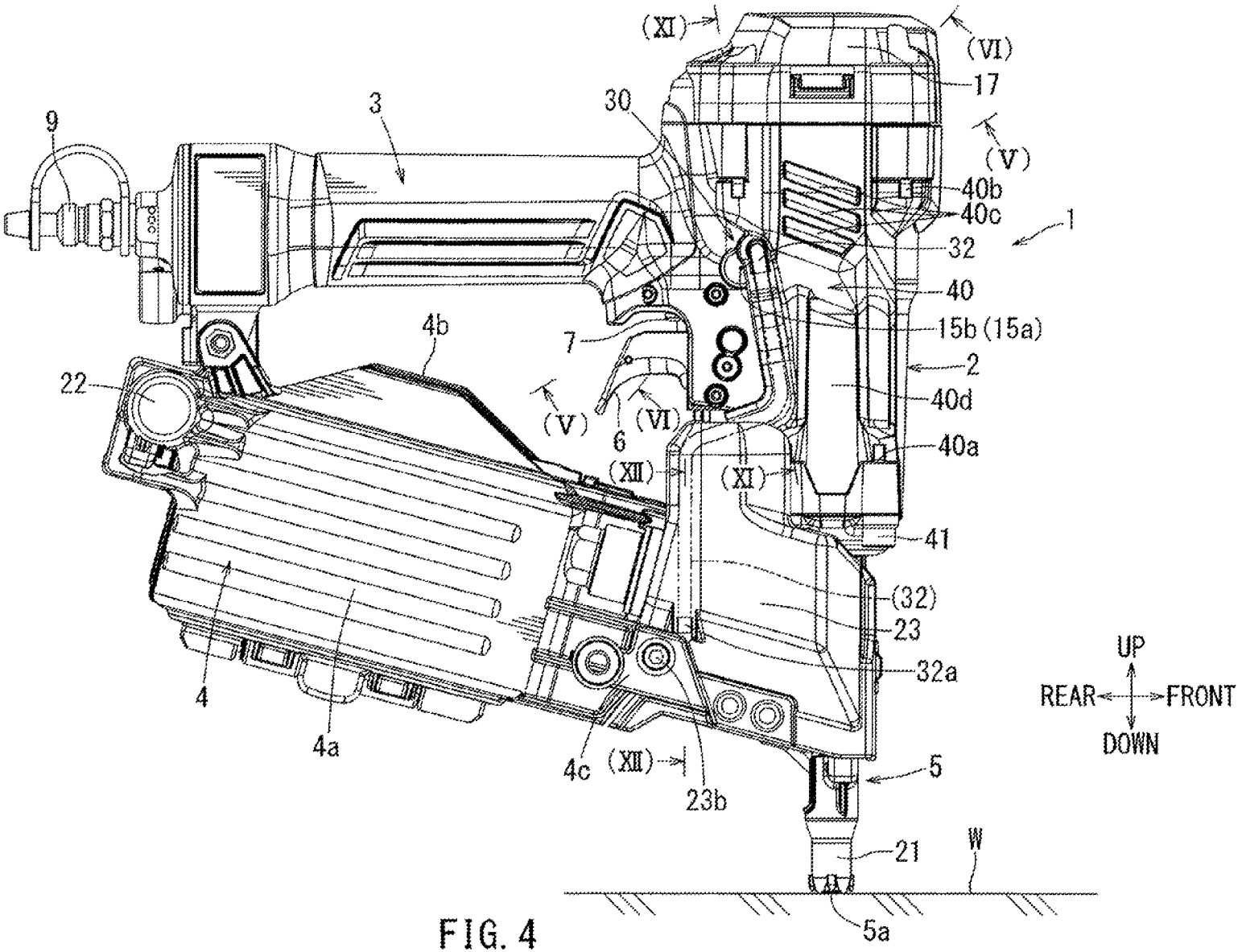
FIG. 4 is an overall side view of the driving tool according to the exemplary embodiment, showing a right side face thereof viewed from the side of the user. This figure shows a state in which the contact arm cover and the exhaust cover are attached to the driving tool and the duster pipe is held and covered by the contact arm cover and the exhaust cover.
Figure 11:
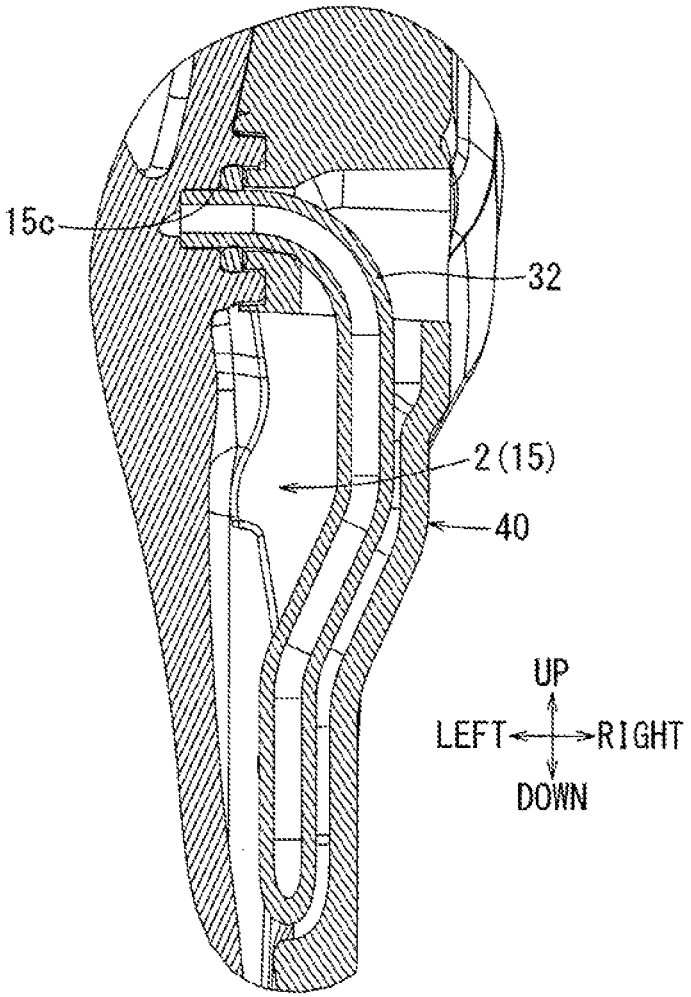
FIG. 11 is a cross-sectional view taken along line (XI)-(XI) of FIG. 4. This figure is the longitudinal sectional view showing a state in which the duster pipe is covered by the exhaust cover in the right side face of the tool main body.
Figure 12:
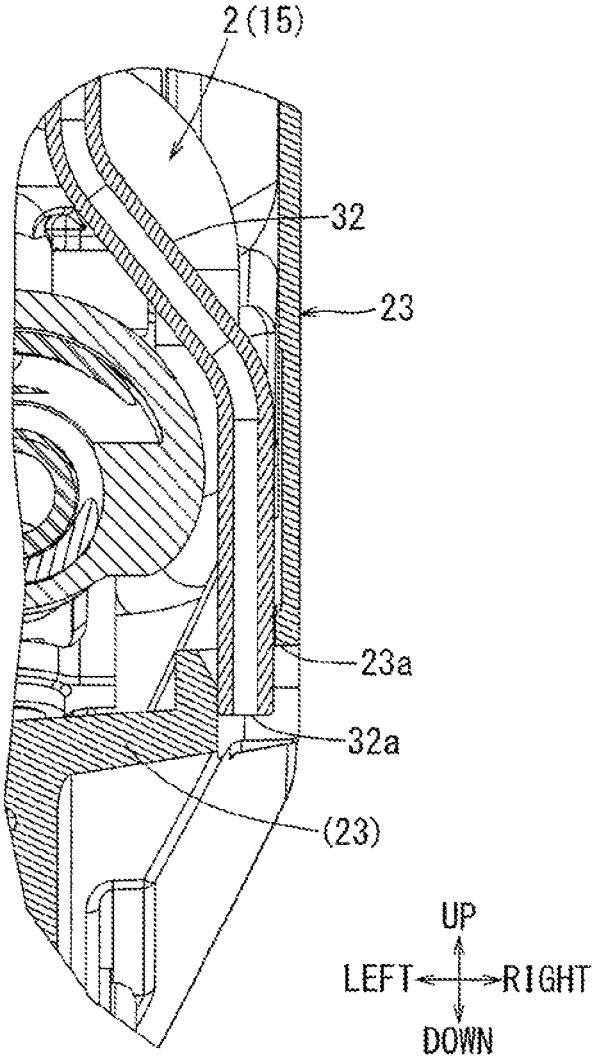
FIG. 12 is cross-sectional view taken along line (XII)-(XII) of FIG. 4. This figure is the longitudinal sectional view showing a state in which the duster pipe is covered by the contact aim cover in the right side face of the tool main body.

As shown in FIGS. 4, 11 and 12, the duster pipe 32 may be covered by and positioned relative to a contact arm cover 23 and an exhaust cover 40 that are attached on the right side of the tool main body 2. Especially, as shown in FIG. 12, a tip end of the duster pipe 32 (blowing-out port 32*a*) may be inserted into a retaining hole 23*a* of the contact arm cover 23 to be held at a predetermined position. Furthermore, a right side of the contact arm 20 may be covered by the contact arm cover 23. FIG. 4 shows the contact arm 20 and the duster pipe 32 by a two-dot chain line, almost all of which are covered by the contact arm cover 23 and the exhaust cover 40.

The contact arm cover 23 may be screw-fastened and fixed to the main body housing 15 by a fixing screw 23*b* at one position. The feeding mechanism 4*c* for feeding the driven members n may also be covered by the contact arm cover 23. In contrast, the exhaust cover 40 may be attached to the main body housing 15 by using a non-conventional new configuration. The driver guide 5 may be attached to the lower portion of the main body housing 15 of the tool main body 2 by use of four fixing screws 41. Furthermore, a top cap 17 may be attached to the upper portion of the main body housing 15 of the tool main body 2 by use of four fixing screws 42. As shown in FIG. 2, the upper portion of the main body housing 15 may be tightly covered by the top cap 17 in a sealed manner. A dumper 18 for a top dead center portion may be attached to the inner surface of the top cap 17. A rubber layer 17 for absorbing impact may be coated on the top cap 17. Furthermore, a dumper for a bottom dead center may be attached to the driver guide 5 that is attached to the lower portion of the main body housing 15.

Figure 9:
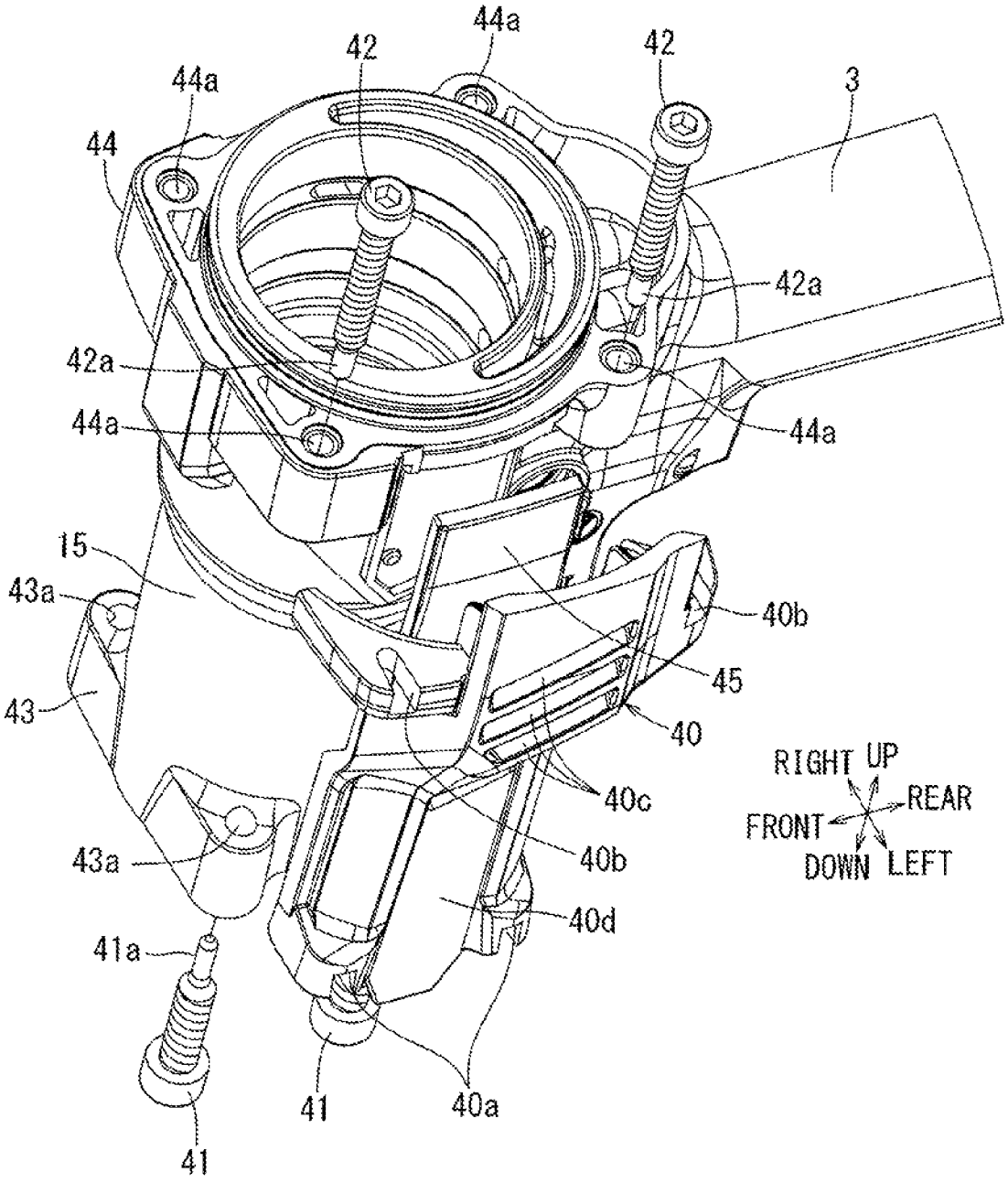
FIG. 9 is an exploded perspective view showing an attachment state of the exhaust cover with respect to a main body housing.

The exhaust cover 40 of the present embodiment may be attached to the main body housing 15 by utilizing a connection means (fixing screws 41) of the driver guide 5 with respect to the main body housing 15 and also a connection means (fixing screws 42) of the top cap 17 with respect to the main body housing 15. FIG. 9 shows a state of the main body housing 15 in which the driver guide 5 and the top cap 17 are removed therefrom. In FIG. 9, only two fixing screws 41 and two fixing screws 42 are shown. However, as described above, the driver guide 5 and the top cap 17 may be attached to the main body housing 15 by use of the four fixing screws 41 and four fixing screws 42, respectively.

An engagement pin 41*a* may be provided at a tip end of each fixing screw 41 so as to be coaxial with and integral to each fixing screw 41. Similar to this, an engagement pin 42*a* may be provided at a tip end of each fixing screw 42 so as to be coaxial with and integral to each fixing screw 42. Each of the engagement pins 41*a* may be formed to have a smaller diameter than a screw thread diameter of the fixing screw 41. Similarly, each of the engagement pins 42*a* may be formed to have a smaller diameter than a screw thread diameter of the fixing screw 42. As shown in FIG. 9, rectangular-flat-shaped connection flanges 43 and 44 may be provided to extend in the lateral directions at the lower portion and the upper portion of the main body housing 15, respectively. Furthermore, screw holes 43*a* and 44*a* may be provided in each of the lower connecting flanges 43 and the upper connecting flanges 44, respectively. As shown in, for example FIG. 8, the driver guide 5 and the lower connecting flange 43 may abut each other, and then each of the four fixing screws 41 may be fastened to the corresponding screw holes 43*a*. As a result, the driver guide 5 may be connected and fixed to the lower portion of the main body housing 15. Furthermore, the top cap 17 and the upper connecting flange 44 may in turn abut each other, and then each of the four fixing screws 42 may be fastened to the corresponding screw holes 44*a*. As a result, the top cap 17 may be connected and fixed to the upper portion of the main body housing 15.

Figure 8:
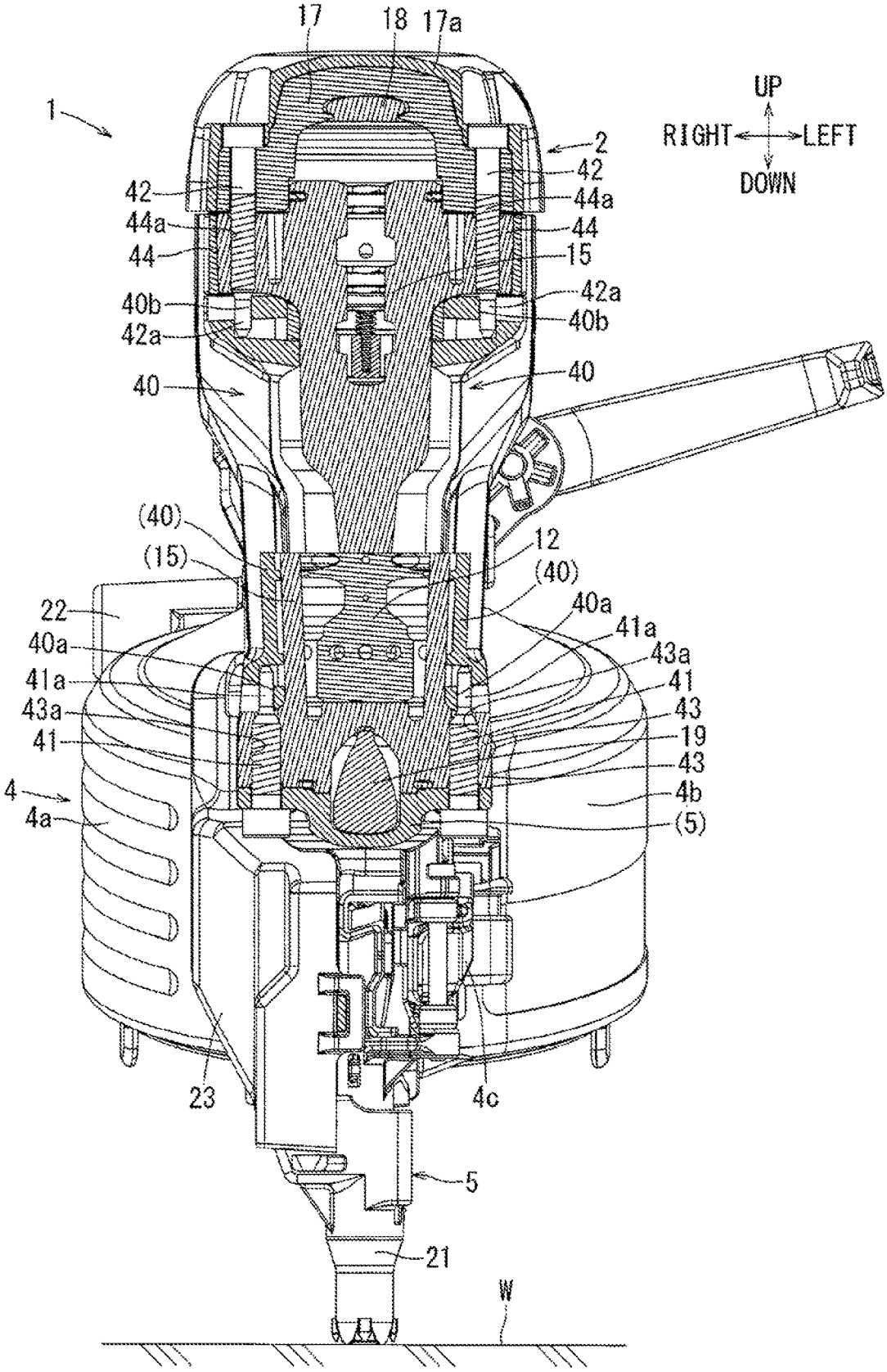
FIG. 8 is cross-sectional view taken along line (VIII)-(VIII) of FIG. 1. This figure shows the cross-sectional view passing through a center of the fixing screw of a top cap.

When the fixing screws 41 and 42, which are eight in total, are fastened to screw holes 43*a* and 44*a* to fix the driver guide 5 and the top cap 17 to the main body housing 15, respectively, the engagement pins 41*a* of the fixing screws 41 and the engagement pins 42*a* of the fixing screws 42 may protrude upwards and downwards from the screw holes 43*a* and 44*a*, respectively, in the up-down direction, as shown in FIG. 8. The exhaust cover 40 may be made from resin and have exhaust slits 40*c*. Furthermore, the exhaust cover 40 may be provided with two lower engagement recesses 40*a* at the lower portion thereof and two upper engagement recesses 40*b* at the upper portion thereof. The engagement pins 41*a* and 42*a* that protrude upwards and downwards from the screw holes 43*a* and 44*a* of the fixing screws 41 and 42 may be inserted to the lower engagement recesses 40*a* and the upper engagement recesses 40*b* of the exhaust cover 40, respectively. As a result, the exhaust cover 40 may be attached to the left side of the main body housing 40. Similarly, another exhaust cover 40 may be attached to the right side of the main body housing 40. In this way, exhaust covers 40 may be attached to each of the left and right side of the main body housing 40.

Figure 7:
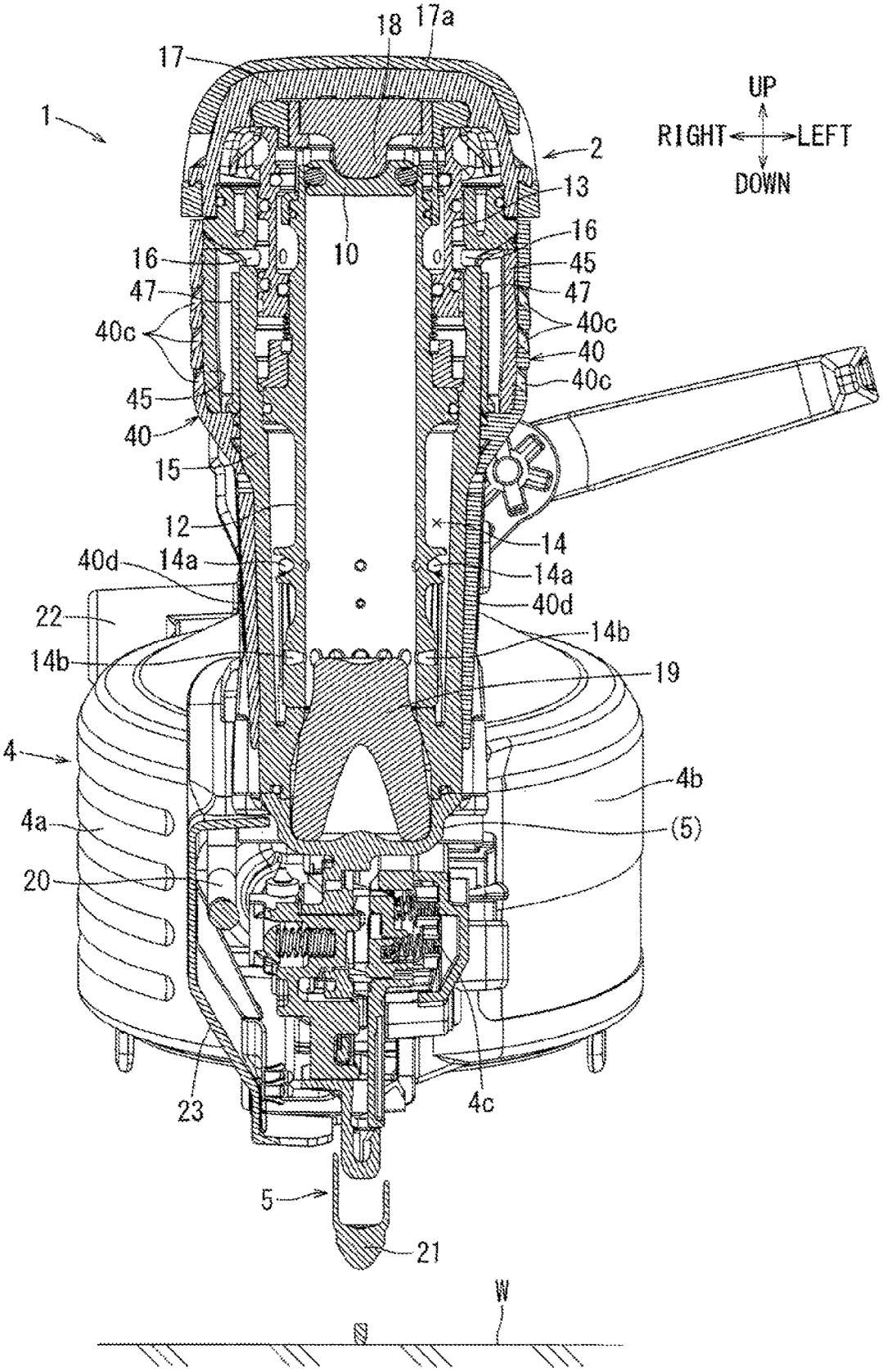
FIG. 7 is a cross-sectional view taken along line (VII)-(VII) of FIG. 1. This figure shows the cross-sectional view passing through an exhaust hole.
Figure 10:
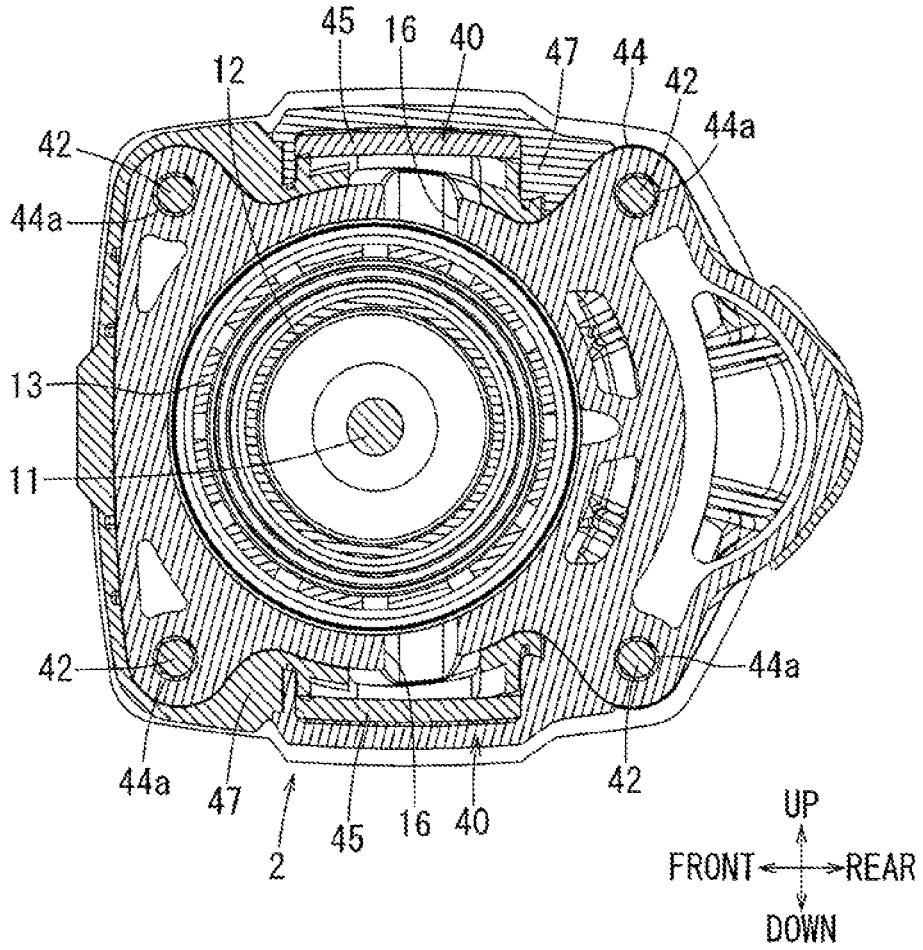
FIG. 10 is a cross-sectional view taken along line (X)-(X) of FIG. 1, showing a lateral cross-sectional view of the tool main body. This figure shows an attachment state of the exhaust cover and a filter with respect to a protector.

A filter 45 for noise reduction may be attached to the inner surface side of the exhaust cover 40, and the inner surface side of the slits 40*c* in particular. Furthermore, the exhaust cover 40 of the present embodiment may be provided with, below the slits 40*c*, a display part 40*d* for showing various kinds of information. Furthermore, a protector 47 (elastomer resin layer) for shock absorption may cover the outer surface of the main body housing 15. As shown in FIGS. 7 and 10, an end edge of the protector 47 may be pushed and fixed by the exhaust cover 40. In this way, the exhaust cover 40 also functions as a fixing means of the protector 47.

According to the driving tool 1 of the present embodiment as described above, the exhaust cover 40 may be fixed to the main body housing 15 both in the driving direction and in its opposite direction by use of the attachment means (fixing screws 41 and 42) of the driver guide 5 and the top cap 17 with respect to the main body housing 15. As a result, the attachment position of the exhaust cover 40 with respect to the main body housing 15 can be stabilized.

Furthermore, the exhaust cover 40 may be attached to the main body housing 15 by being held between the driver guide 5 and the top cap 17 both in the driving direction and in its opposite direction. In this respect, the attachment position of the exhaust cover 40 with respect to the main body housing 15 can be stabilized.

Furthermore, the duster pipe 32 of the air duster device 30 may be positioned and held by the exhaust cover 40. Thus, the configuration for positioning and holding the duster pipe 32 can be simplified. By simplifying the configuration for positioning and holding the duster pipe 32, ease of assembly and maintenance of the air duster device 30 can be improved, helping to reduction cost.

Furthermore, the exhaust cover 40 according to the present embodiment may be provided with the information display part 40*d*. For example, specifications of the cutting tool 1 or cautions for handling the cutting tool 1 can be displayed on display part 40*d*. By providing the display part 40*d* on the exhaust cover 40 attached to both the left and right sides of the main body housing 15, this provides an ample display area for showing a variety of this kind of information, which is then easily obtainable by the user.

Furthermore, the exhaust cover 40 may be attached to the main body housing 15 in a manner such that the end edge of the elastomer rubber layer 47 for absorbing impact is held between the exhaust cover 40 and the main body housing 15. Because of this configuration, air leakage between the exhaust cover 40 and the main body housing 15 can be prevented and exhaust efficiency is improved.

The embodiments discussed above may be further modified without departing from the scope and spirit of the present teachings. In the above-discussed embodiments, both the left and right exhaust covers 40 have the same attachment configuration. However, for example, either one of the exhaust covers 40 may be configured to be directly attached to the outer surface of the main body housing 15 by fixing screws rather than using the tip ends of screws 41 or 42.

Furthermore, in the above-discussed embodiments, the exhaust cover 40 is attached to the main body housing 15 by utilizing both the attachment means (fixing screws 41) of the driver guide 5 with respect to the main body housing 15 as well as the attachment means (fixing screws 42) of the top cap 17 with respect to the main body housing 15. However, instead of using these attachment means, other engagement pins provided on the driver guide 5 and the top cap 17 themselves may be configured to be inserted to and engaged with the exhaust cover 40 such that the exhaust cover 40 on both the left and right sides is held and attached between the driver guide 5 and the top cap 17.

Furthermore, the display part 40*d* of the exhaust cover 40 and the configuration in which the duster pipe 32 is positioned may be omitted.

Furthermore, according to the above-discussed driving tool 1 of the present embodiment, the duster valve 31 is arranged on the side of the base portion of the handle 3. Because of this configuration, in comparison with a conventional configuration in which the duster valve is arranged at the tip end of the handle 3 (at the inlet from which outside air is introduced), the configuration of the inlet can be simplified. Because of this simplification of the inlet of the handle 3, the handle 3 can also be shortened, for example, by approximately 13 mm. In this respect, handling property of the driving tool 1 can be improved.

Furthermore, according to the above-discussed embodiment, the valve stem 38 of the duster valve 31 is configured to be movable in the width direction of the handle 3 (in the left-to-right direction). Because of this configuration, the duster valve 31 can be assembled compactly into the handle 3, along its width. As a result, the overall configuration of the air duster device 30 is simplified, and ease of assembly and maintenance of the air duster device 30 can be improved.

Furthermore, according to the above-discussed embodiment, the duster valve 31 is arranged between the base portion of the handle 3 and the cylinder 12 that houses the piston 10. Because of this configuration, the duster valve 31 can be arranged in such a position that the user can easily operate the duster valve 31 with his or her finger while holding the handle 3 by pushing button 36 at the side of the handle 3. In this respect, a configuration of the air duster device 30 can be simplified. In particular, the duster valve 31 is arranged to the rear side of the downward driving direction (with respect to the switch lever 6 for conducting the driving operation of the driving tool 1). Because of this configuration, while holding the handle 3, the user can pull the switch lever 6 upward with his or her fingertip, for example the fingertip of the index finger, and at the same time the user can operate the duster valve 31 with his or her thumb by pushing button 36 in the left-to-right direction at the side of the handle 3 at a roughly orthogonal direction. In this respect, operability of the air duster device 30 can be furthermore improved.

Furthermore, according to the above-discussed embodiment, the driving tool 1 includes the contact arm cover 23 that covers the contact arm 20 and the exhaust cover 40 that covers the exhaust hole 16 of the tool main body 2. Because of this configuration, the duster pipe 32 can be configured to be fixed along the lateral side of the tool main body 2 by the contact arm cover 23 and the exhaust cover 40. As a result, a configuration for holding means of mainly the duster pipe 32 can be simplified, further improving ease of assembly and maintenance of the air duster device 30.

The embodiments discussed above may be further modified without departing from the scope and spirit of the present teachings. In the above-discussed embodiments, the duster button 36 is arranged on the left side of the tool main body 2. However, alternatively, the duster button 36 can be arranged on the right side of the tool main body 2. Furthermore, the duster button can be arranged on each side of the tool main body 2 such that the user can operate either one of the left and right side duster buttons.

Furthermore, in the above-discussed embodiments, the valve stem 38 is configured to be movable in the left-to-right direction. However, alternatively, the duster valve can be configured such that the valve stem 38 is movable, for example, in the front-to-rear direction or in the oblique up-to-down direction.

What is claimed is:

1. A driving tool, comprising:

a piston configured to be driven by compressed air and move in a reciprocating manner;

a tool main body housing the piston;

a driver configured to drive a driven member in a driving direction;

a driver guide attached to a bottom end of the tool main body in the driving direction and configured to guide the driver;

a top cap attached to an upper end of the tool main body in the driving direction and sealing an upper piston chamber; and an exhaust cover disposed on a lateral side of the tool main body, the exhaust cover including;

a bottom end of the exhaust cover in the driving direction attached to a main body housing of the tool main body via a first fixing screw of the driver guide, the first fixing screw including a first tubular engagement pin integrally disposed at a tip end of the first fixing screw, a top end of the exhaust cover in the driving direction attached to the main body housing via a second fixing screw of the top cap, the second fixing screw including a second tubular engagement pin integrally disposed at a tip end of the second fixing screw, and a lower recess at a lower side of the exhaust cover and an upper recess at an upper side of the exhaust cover, each one of the lower recess and the upper recess being inwardly recessed in a side face area in a planar view of the exhaust cover, the first tubular engagement pin being inserted into and engaging the lower recess at the lower side of the exhaust cover, and the second tubular engagement pin being inserted into and engaging the upper recess at the upper side of the exhaust cover.

2. The driving tool according to claim 1, wherein the bottom and the top of the exhaust cover in the driving direction are each fixed to the main body housing at two positions, respectively.

3. The driving tool according to claim 1, further comprising:

an air duster device configured to blow out the compressed air from a duster pipe by performing an independent operation, the duster pipe being retained by the exhaust cover.

4. The driving tool according to claim 1, wherein the exhaust cover includes a display part.

5. The driving tool according to claim 1, wherein a seal member is interposed between the exhaust cover and the main body housing.

6. A driving tool comprising:

a piston configured to be driven by compressed air and move in a reciprocating manner;

a tool main body housing the piston;

a driver configured to drive a driven member in a driving direction:

a driver guide attached to a bottom end of the tool main body in the driving direction and configured to guide the driver;

a top cap attached to an upper end of the tool main body in the driving direction and sealing an upper piston chamber; and an exhaust cover disposed on a lateral side of the tool main body, the exhaust cover including:

a lower recess at a lower side of the exhaust cover in the driving direction and an upper recess at an upper side of the exhaust cover in the driving direction, each one of the lower recess and the upper recess being inwardly recessed in a side face area in a planar view of the exhaust cover;

a first fixing screw attaching the driver guide to the tool main body, the first fixing screw, including a first tubular engagement pin integrally disposed at a tip end of the first fixing screw, the first tubular engagement pin being inserted into and engaging the lower recess at the lower side of the exhaust cover; and a second fixing screw attaching the top cap to the tool main body, the second fixing screw including a second tubular engagement pin integrally disposed at a tip end of the second fixing screw, the second tubular engagement pin being inserted into and engaging the upper recess at the upper side of the exhaust cover, such that the exhaust cover is fixed to a main body housing of the tool main body at the lower side of the exhaust cover by the first fixing screw and at the upper side of the exhaust cover by the second fixing screw.

7. The driving tool according to claim 6, further comprising:

a handle configured for holding the driving tool;

an accumulator disposed in the handle and configured to supply the compressed air to the piston;

an air duster device configured to blow out the compressed air independently from a driving operation of the tool main body and be operated while the handle is held, the air duster device including (i) a duster valve configured to open and close the accumulator, and (ii) a duster pipe configured to guide compressed air from the accumulator to a blow-out port where compressed air is blown out when the duster valve is opened, the duster pipe extending along the tool main body, the duster valve including a valve stem configured to move in a width direction of the handle.

8. The driving tool according to claim 7, wherein the duster valve is disposed between a base portion of the handle and a cylinder housing the piston.

9. The driving tool according to claim 7, further comprising:

a trigger switch lever configured to activate the driving operation of the tool main body and be operated while the handle is being held, wherein the duster valve is disposed on a upper side of the trigger switch lever in the driving direction.

10. The driving tool according to claim 7, wherein the blow-out port of the duster valve is disposed between a base portion of the handle, at a front of the handle, and a cylinder housing the piston, in a direction in which the handle extends.

11. The driving tool according to claim 7, further comprising:

a contact arm cover covering a contact arm configured to enable and disable a driving operation of the tool main body, wherein the duster pipe is held along the lateral side of the tool main body by the contact arm cover and the exhaust cover.

12. A driving tool comprising:

a disk-shaped piston configured to be driven by compressed air and move in a reciprocating manner in a driving direction;

a tubular tool main body housing an inner concentric tubular cylinder in which the piston is configured to move;

a cylindrical driver extending axially in the driving direction and configured to drive a driven member out of an injection port at a lower distal axial end of the driving tool;

a driver guide attached to a bottom end of the tool main body in the driving direction and configured to drive the driver;

a top cap attached to an upper end of the tool main body in the driving direction and sealing an upper piston chamber; and an exhaust cover disposed on a lateral side of the tool main body; the exhaust cover including;

a lower recess at a lower side of the exhaust cover in the driving direction and an upper recess at an upper side of the exhaust cover in the driving direction, each one of the lower recess and the upper recess being inwardly recessed in a side face area in a planar view of the exhaust cover;

a first fixing screw attaching the driver guide to the tool main body, the first fixing screw including a first engagement pin integrally disposed at a tip end of the first fixing screw, the first engagement pin being inserted into and engaging the lower recess at the lower side of the exhaust cover; and a second fixing screw attaching the top cap to the tool main body, the second fixing screw including a second engagement pin integrally disposed at a tip end of the second fixing screw, the second engagement pin being inserted into and engaging the upper recess at the upper side of the exhaust cover, such that the exhaust cover is fixed to a main body housing of the tool main body at the lower side of the exhaust cover by the first fixing screw and at the upper side of the exhaust cover by the second fixing screw.

13. The driving tool according to claim 12, further comprising:

a cylindrical handle configured for holding the driving tool and extending orthogonal to the tubular main body at an upper portion of the tubular tool main body;

an accumulator including a cylindrical interior disposed in the handle, the accumulator being configured to supply compressed air to the piston;

an air duster device configured to blow out compressed air from the bottom of the air duster device independently from a driving operation of the tubular tool main body and be operated while the handle is held, the air duster device including (i) a duster valve configured to selectively allow compressed air to pass, and (ii) a duster pipe extending along the tool main body and configured to guide compressed air from the accumulator to a blow-out port at the bottom of the driving tool in a vicinity of the driver guide where compressed air is blown out when the duster valve is opened, the duster valve including a valve stem configured to move in a left-to-right width direction of the handle.

14. The driving tool according to claim 13, wherein the duster valve is disposed between a frontal base portion of the handle and the inner concentric tubular cylinder.

15. The driving tool according to claim 13, further comprising:

a trigger switch lever configured to activate the driving operation of the tool main body and be operated by being pulled upward while the handle is being held, wherein:

the duster valve is disposed on an upper side of the trigger switch lever in the driving direction, the duster valve being configured to be operated in a left-to-right direction that is orthogonal to a pulling upward direction of the switch lever, and the duster valve and the trigger switch lever are configured to operated simultaneously by a thumb and a fingertip of an index finger of the user, respectively.

16. The driving tool according to claim 13, wherein the blow-out port of the duster valve is disposed in the front-to-rear direction between the base portion of the handle, at the front of the handle, and the inner concentric tubular cylinder.

17. The driving tool according to claim 13, further comprising:

a contact arm cover covering a contact arm configured to enable and disable a driving operation of the tool main body, wherein the duster pipe is held along the lateral side of the tool main body by the contact arm cover and the exhaust cover.

18. The driving tool of claim 12, wherein the first engagement pin of the first fixing screw has a shape that is complementary to a shape of the lower recess of the exhaust cover and the second engagement pin of the second fixing screw has a shape that is complementary to a shape of the upper recess of the exhaust cover.

19. The driving tool according to claim 11, wherein the duster pipe is held inside of the contact arm cover and the exhaust cover and is covered by the contact arm cover and the exhaust cover.

20. The driving tool according to claim 17, wherein the duster pipe is held inside of the contact arm cover and the exhaust cover and is covered by the contact arm cover and the exhaust cover.

* * * * *